US009812751B2

(12) United States Patent
Puoskari et al.

(10) Patent No.: US 9,812,751 B2
(45) Date of Patent: Nov. 7, 2017

(54) PLURALITY OF RESONATOR CAVITIES COUPLED BY INDUCTIVE APERTURES WHICH ARE ADJUSTED BY CAPACITIVE PARTS

(71) Applicant: Intel Corporation, Santa Clara, CA (US)

(72) Inventors: Jukka Puoskari, Tupos (FI); Petri Päri, Kempele (FI)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 14/778,760

(22) PCT Filed: Jun. 25, 2014

(86) PCT No.: PCT/IB2014/001987

§ 371 (c)(1),
(2) Date: Sep. 21, 2015

(87) PCT Pub. No.: WO2015/008150

PCT Pub. Date: Jan. 22, 2015

(65) Prior Publication Data

US 2016/0049716 A1 Feb. 18, 2016

Related U.S. Application Data

(60) Provisional application No. 61/839,093, filed on Jun. 25, 2013.

(51) Int. Cl.
*H01P 1/205* (2006.01)
*H01P 7/04* (2006.01)
(Continued)

(52) U.S. Cl.
CPC ..... *H01P 1/2053* (2013.01); *H01P 1/20* (2013.01); *H01P 7/04* (2013.01); *H01P 7/06* (2013.01)

(58) Field of Classification Search
CPC ..... H01P 1/205; H01P 1/2053; H01P 1/2056; H01P 7/04
(Continued)

(56) References Cited

U.S. PATENT DOCUMENTS 6,320,483 B1 * 11/2001 Raty et al. ..... H01P 1/2053 333/203
6,836,198 B2 * 12/2004 Engst ..... H01P 1/2053 333/202
(Continued)

FOREIGN PATENT DOCUMENTS

WO WO-2015008150 A2 1/2015
WO WO-2015008150 A3 1/2015

OTHER PUBLICATIONS

"International Application Serial No. PCT/IB2014/001987, International Search Report mailed Nov. 14, 2014", 6 pgs.
(Continued)

*Primary Examiner* — Benny Lee
(74) *Attorney, Agent, or Firm* — Schwegman Lundberg & Woessner, P.A.

(57) ABSTRACT

One or more adjustable resonators (208, 209) of a compensation circuit are arranged so that adjusting the resonators nevertheless results in output of the circuit remaining substantially constant. This has been accomplished by separating resonator cavities that include the adjustable resonators by a partition wall. A coupling aperture (205) provides inductive coupling between the resonator cavities and a capacitive part (206) passes through the intermediate wall and provides a capacitive coupling between the resonator cavities. The capacitive part is conductive and electrically isolated from the partition wall. The capacitive part and the coupling aperture are dimensioned such that effects on the coupling band width of the aperture and capacitive couplings track each other so as to substantially cancel each
(Continued)

other out, and that the coupling band width between the resonator cavities remains substantially constant.

10 Claims, 4 Drawing Sheets

(51) Int. Cl.
*H01P 1/20* (2006.01)
*H01P 7/06* (2006.01)
(58) Field of Classification Search
USPC ..... 333/203
See application file for complete search history.

(56) References Cited

U.S. PATENT DOCUMENTS

| | | | | |
|---|---|---|---|---|
| 2006/0238275 | A1* | 10/2006 | Burger | H01P 11/007 333/202 |
| 2009/0310972 | A1 | 12/2009 | Wayman et al. | |
| 2009/0311969 | A1 | 12/2009 | Wayman et al. | |
| 2010/0296816 | A1 | 11/2010 | Larsen | |
| 2011/0008042 | A1 | 1/2011 | Stewart | |
| 2011/0188220 | A1 | 8/2011 | Blackwell, Jr. et al. | |

OTHER PUBLICATIONS

"International Application Serial No. PCT/IB2014/001987, Written Opinion mailed Nov. 14, 2014", 9 pgs.
"Chinese Application Serial No. 201480029389, Response filed Jun. 19, 2017 to Office Action dated Feb. 4, 2017", w/ English Claims, 7 pgs.
"Chinese Application Serial No. 201480029389.0, Office Action dated Aug. 10, 2017", w/English Translation, 7 pgs.

* cited by examiner

PLURALITY OF RESONATOR CAVITIES COUPLED BY INDUCTIVE APERTURES WHICH ARE ADJUSTED BY CAPACITIVE PARTS

This application is a U.S. National Stage Filing under 35 U.S.C. 371 from International Application No. PCT/IB2014/001987, filed Jun. 25, 2014 and published in English as WO 2015/008150 on Jan. 22, 2015, which claims the benefit of priority to U.S. Provisional Application Ser. No. 61/839,093, filed on Jun. 25, 2013, each of which is incorporated herein by reference in its entirety.

BACKGROUND OF THE INVENTION

1. Field of the Invention

The invention relates to the arrangement of adjustable resonators between the concoction of a resonator with a bottom, walls and a lid consisting of the transmission path inner conductor casing, which is divided by conductive intermediate walls into resonator cavities. The inner conductor of the resonator cavities is in electrical connection with the inner conductor casing and the resonator cavities in the transmission path of successive cavities are joined by at least one connecting aperture in the separating intermediate walls, the connecting aperture is arranged to form an inductive coupling between the resonator cavities. In addition, the invention relates to a method for forming an adjustable coupling between the resonator cavities.

2. Description of the Prior Art

Common radio frequency resonators are different irons cavity and coaxial resonators, since they can be built with low loss and relatively high powers are sustained by filters containing them. The basic structure of the resonator includes an inner conductor, which includes side walls, an outer conductor, a bottom and a lid. The bottom or base and lid are in a galvanic connection with the outer conductor, and all three together form a closed resonant resonator case. Typically, the lower end of the inner conductor is galvanically linked to the bottom and the upper end to air. When forming a transmission line resonator the inner conductor is short-circuited at its lower end and open at its upper end.

Cavity resonators are commonly used for making the filters in telecommunications networks, in particular, when the transmitted signal power is relatively high. This is because losses are due to smaller resonator filters, which is only a very small attenuation related to the efficiency of the signal. In addition, the response characteristics are well controllable and adjustable to most stringent specifications. Most of the filters and the filter pass band width of the space are intended to be fixed. For some of the filters, the filter passband width is constant. This filter is required in addition to the basic tuning range for the pass-band transmission.

A bandpass filter frequency response arranged to conform to the pass band has to be correctly positioned and must be of the correct band width. In the resonator filter, this requires that the resonant frequency of each resonator is the eigenfrequency of the resonator, and in addition, the couplings between the resonators, have the correct intensity. The series of cavity resonators that constitute the filter are formed with mechanical dimensions so that these conditions are met as well. In practice, the manufacturing process is not accurate enough, so that the filter is tuned before use.

Sequential coupling between the resonators is achieved by the resonator cavity's gap between partition walls, which forms the inductive coupling between the resonators. When the resonators of a device, such as a filter, have the fundamental frequency changed downwardly, the inductive coupling is reduced linearly with frequency. Changing the frequency bands, in turn changes the properties of the device. FIG. 1 shows how a change in resonance frequency in GHz of the adjustable resonators affects the resonant frequency band width (BW) of the coupling. The amount of coupling is described in the pass band width, and its unit is MHz.

The resonators and/or the coupling between the resonators can be tuned by changing the volume of the resonator and/or the coupling. When tuning resonators, vibration occurs in the connections of the resonators. The adjustment of the coupling affects the filter band width. Both of these adjustments (i.e. changing the volume of the resonator cavities and the coupling) can be carried out in several ways. The traditional method is to provide a structure with metallic tuning screws so that the tuning screws extend into the resonator cavities and/or to the coupling between the resonator cavities. For example, rotating the coupling adjustment screw further into the aperture between the resonators to increase the coupling between the resonators, which has a bandwidth broadening effect. Such an excitation is time-consuming and therefore relatively expensive. What is needed is an improved coupling arrangement between cavity filter resonators.

SUMMARY OF THE INVENTION

The present invention is an arrangement for compensating the coupling between resonators in such a way that the coupling between the resonators remains substantially constant. This has been accomplished by placing an aperture in the partition wall between the resonator cavities, producing the inductive coupling between resonator cavities, in addition a capacitive part, which is galvanically isolated from the partition wall, produces a capacitive component of the coupling between the resonators. The capacitive component and the coupling aperture are dimensioned such that changes in the coupling resonator due to the coupling aperture and due to the capacitive component substantially cancel each other out, such that the coupling between the resonators remains substantially constant.

According to one embodiment of the arrangement, the adjustable resonators are formed by the bottom, walls and the lid, which is the transmission path casing. The casing is divided by conductive intermediate walls between the resonator cavities. In the resonator cavities, the inner conductor is in electrical connection with the casing and the resonator cavity with the transmission path of successive cavities in the separating walls. At least a coupling aperture is provided which is arranged to form the inductive coupling between the resonators. According to a preferred embodiment, the arrangement also has at least one capacitive piece, which is arranged to form a capacitive coupling between the resonators. The capacitive piece, has a first end in a first resonant cavity and a second end in a second resonator cavity. The capacitive component is galvanically isolated from the partition wall.

In an arrangement according to the invention in one embodiment, the capacitive part is an elongated plate-like piece. In an arrangement according to the invention in another embodiment, the first and second capacitive part ends are shaped to enhance coupling. According to another arrangement of the invention, in a certain third performance mode the surfaces of the ends of the capacitive piece are larger than the surface of a cross-section of the capacitive piece. In an arrangement according to the invention in a third embodiment, the ends of the capacitive part surface are greater than the capacitive part cross-sectional area. In an arrangement according to the invention in a fifth embodiment, the resonance tracking caused by the capacitive piece is less than the absolute value of the resonance tracking of the inductive coupling aperture. In an arrangement according to the invention in a sixth embodiment, the resonance tracking caused by the capacitive piece has a magnitude of 40%-60% of the resonance tracking caused by the inductive coupling aperture. In an arrangement according to the invention in a seventh embodiment, the coupling aperture or apertures and the coupling capacitive piece are arranged so that respective changes in the frequency of the resonator due to the inductive coupling and due to the capacitive coupling substantially cancel each other out. In an arrangement according to the invention in a eighth embodiment the capacitive part or capacitive parts are fixed in place; i.e., stationary.

According to one embodiment of a method of the invention is disclosed for adjustable resonators coupling between a bottom, walls and a lid of the resonator having a transmission path casing, which is divided by conductive intermediate walls into resonator cavities and, in the resonator cavities, the inner conductor is in electrical connection with the casing. Each resonator cavity has a transmission path to a next successive cavity formed by a coupling aperture in the separating wall. The coupling aperture is arranged to form the inductive coupling between the resonators. According to a preferred embodiment, the coupling between the two resonator cavities also includes at least one capacitive part having a first end in a first one of the resonator cavities and a second end in a second one of the resonator cavities. The capacitive part is made of a conductive material and it is galvanically isolated from the partition wall. The method has the steps of configuring the aperture and the capacitive part to form coupling between the resonators. That capacitive component is configured so that the frequency band width change caused by the inductive coupling and the frequency band width change caused by the capacitive coupling substantially cancel each other out, and the bandwidth of the resonator and the coupling will remain substantially constant.

An advantage of the present invention is that it achieves an arrangement in which the coupling between the resonators remains substantially the same while frequency adjusting without moving parts. In addition, the present invention has the advantage that its structure is simple and thus the production cost is reduced and component and subsystem failures decrease. Furthermore, the invention has the advantage that it will facilitate and accelerate adjustment. Further, the invention enables the reproducibility of settings to produce the same results. The invention also has the advantage that the resonance frequency of the filter does not change with time because the adjustable components (e.g. the tuning screws in the coupling between the resonator cavities) can be reduced. Active control is not needed.

BRIEF DESCRIPTION OF THE DRAWINGS

The invention will now be described in detail. In the description reference is made to the accompanying drawings, in which.

DETAILED DESCRIPTION OF THE INVENTION

In the following description, the embodiments are exemplary only and the person skilled in the basic idea of the invention will understand that other embodiments may be structured in some other way than described in the specification. Although the description may refer to one or more embodiments, it does not mean that the description is limited to the described embodiment or feature or that the invention described would be useful only in conjunction with the illustrated embodiment. Two or more individual features of embodiments can be combined and thus provide novel embodiments of the invention.

Figure 1:
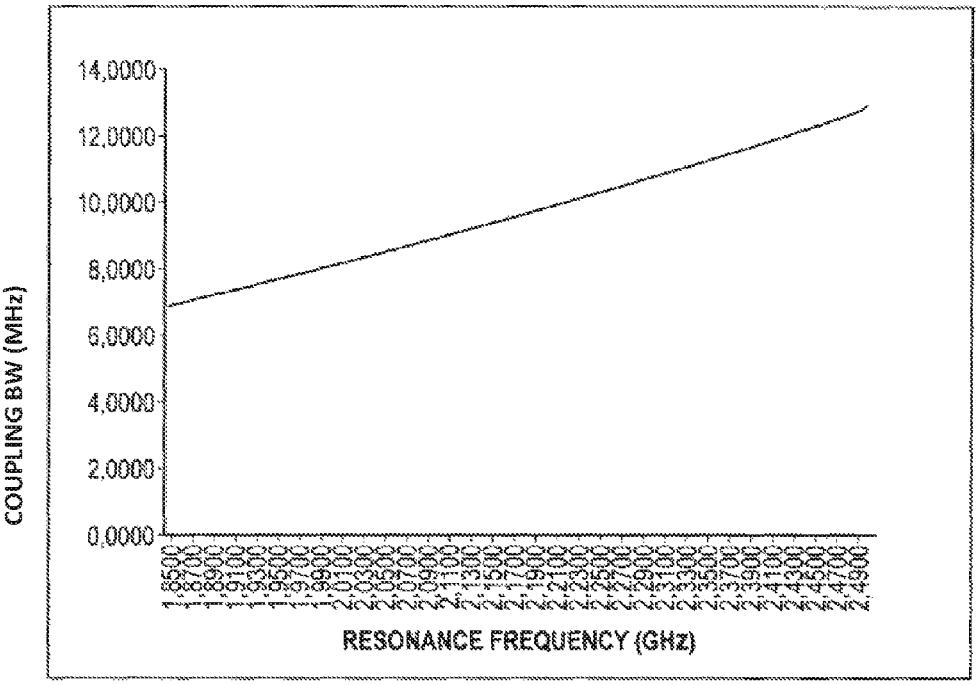
FIG. 1 PRIOR ART
FIG. 1 is a graph of resonance frequency in GHz versus coupling band width (BW) in MHz that illustrates a dependency between coupling band width (BW) and the resonance frequency.

FIG. 1 shows the prior art coupling resonance band width provided by an existing cavity resonators over a range of frequencies.

Figure 2:
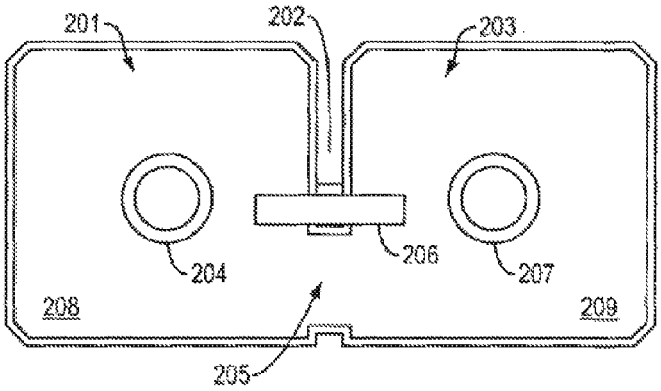
FIG. 2 shows an example of an arrangement according to the present invention.

In FIG. 2, there are two resonators: a first resonator 208 and a second resonator 209. The first resonator 208 includes a first resonator cavity 201, which is surrounded by a bottom, a wall and a cover. These form a resonator shell. The first resonator cavity 201 includes a first inner conductor 204, which is in electrical connection with the casing. In the example, the inner conductor is attached to the bottom, but other solutions are possible. A second resonator cavity 203 includes a second inner conductor 207. A partition wall is between the resonator cavities 201 and 203. Leading partition 205 includes a coupling aperture. The coupling aperture forms an inductive coupling between the resonators 208 and 209.

The first resonator cavity 201 and the second resonator cavity 203 include a capacitive part 206. The capacitive part 206 has an elongated part which penetrates septum 202. The capacitive part 206 has a shape and a location relative to the partition wall that are substantially symmetrical in relation to the inner conductors 204 and 207. The capacitive part 206 is made of a conductive material. The capacitive part is arranged in such a way that the capacitive part is galvanically isolated from the partition wall. In this example, the capacitive part 206 is placed so that the capacitive part includes a first region and a second region between the inner conductors. In one example of the invention, the capacitive part 206 is plate-shaped, but other shapes are possible, for example, rods, tubes, or a combination of several forms.

The capacitive part 206 forms a capacitive coupling between the resonators. Thus, for example, in the case of the coupling aperture being formed by inductive and capacitive coupling, these connections are opposite to each other.

When the frequencies of the resonators are changed, inductive and capacitive coupling also change. For example, when the frequency of the resonators are moved downwardly, the two couplings are reduced. Due to the characteristics of the capacitive coupling, the capacitive coupling is reduced more quickly than the inductive coupling. Both connection changes cancel each other out, and the overall connection will remain roughly the same in spite of the frequency adjustment. Studies have shown that the best results are obtained when the coupling aperture and the capacitive part 206 are selected so that the amount of capacitive coupling is smaller than the absolute value of the inductive coupling. Absolute value of the amount of capacitive coupling is from 40% to 60% of the inductive coupling if the coupling aperture. The capacitive part is shown in FIG. 2 as a single piece but the capacitive part may be made in two or more pieces. This may be the case, for example, to control resonances. A unitary capacitive part may produce resonances that can grow too much. In order to reduce the growth of the resonances, the capacitive part may be made in capacitive pieces. Adjusting the resonance frequency of the resonator has a resonator control arrangement.

Figure 3:
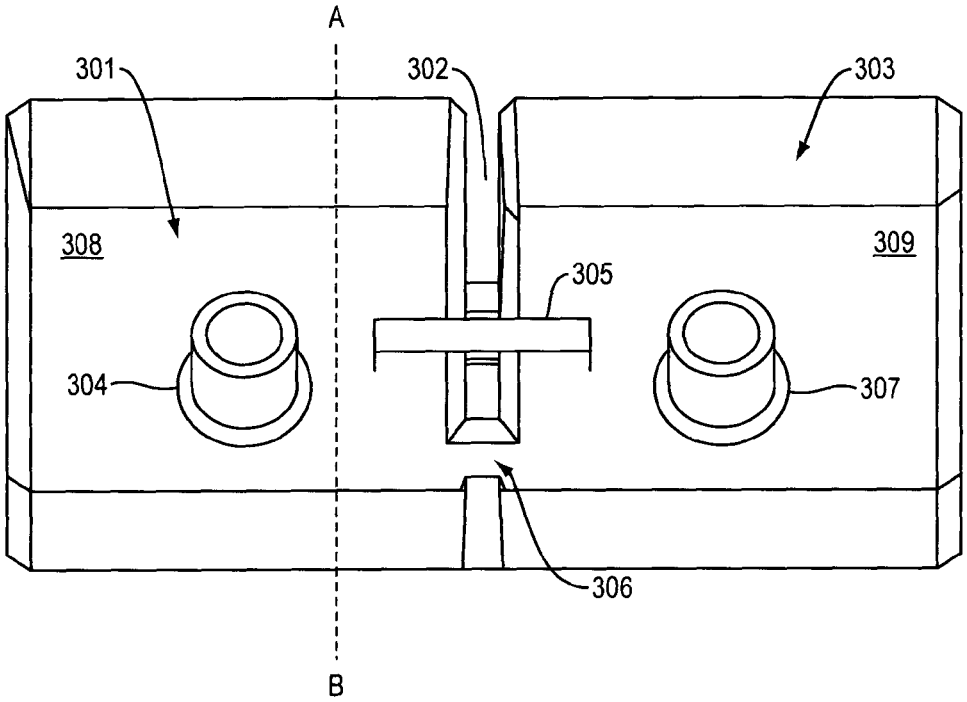
FIG. 3 shows a second example of an arrangement according to the present invention.

FIG. 3 shows a second example of an arrangement according to the present invention. The arrangement consists of two resonators: a first resonator 308 and a second resonator 309. The first resonator has a first resonator cavity 301, and a first inner conductor 304. The second resonator 309 includes a second resonator cavity 303 and a second inner conductor 307. A partition wall 302 separates the resonator cavities and includes a coupling neck or aperture 306. The walls of the coupling aperture 306 are shaped to be compatible with capacitive part 305. Capacitive part 305 has a first and a second end, with the first end in the first resonator cavity 301 and the second end in the second resonator cavity 303. The first and second ends are shaped to enhance coupling. In this formulation, the surface areas of the ends of the capacitive part 305 are larger than the cross-sectional area of the capacitive part 305. This can been done, for example, by bending a plate-like version of the capacitive part 305 or by connecting the ends of an additional piece. A mounting hole in the partition wall is designed to galvanically isolate the capacitive part 305 from the partition wall 302. In this example, the mounting hole may include insulation may be a plastic, and bolts may be used to join pieces together. There are also other ways to attach alternative components of the capacitive part 305. For example, the capacitive parts may be arranged to extend through the aperture 306 and may be attached to the casing, for example, with plastic plugs. This may be useful if the coupling aperture 306 is not of a desired format or of desired dimensions.

Figure 4:
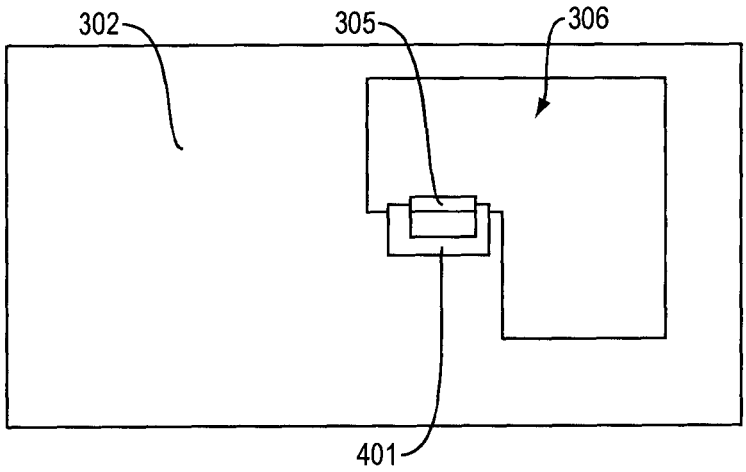
FIG. 4 shows a section A-B of the FIG. 3 example.

FIG. 4 is an example of a portion of the cavity resonator of FIG. 3 taken at cross-section line A-B in the direction parallel to the direction of the partition wall 302. The drawing shows in more detail the coupling aperture 306 and capacitive part 305 as placed with respect to the partition wall 302. The partition wall 302 between the inner conductors of the resonators separates the resonators and includes a coupling aperture 306. Capacitive pieces of capacitive part 305 are separated by the partition wall. Insulating part 401 separates the partition wall 302 from the capacitive part 306. The size of the insulating part 401 and its material are selected so that the capacitive part 305 is galvanically isolated from the partition wall 302.

Figure 5:
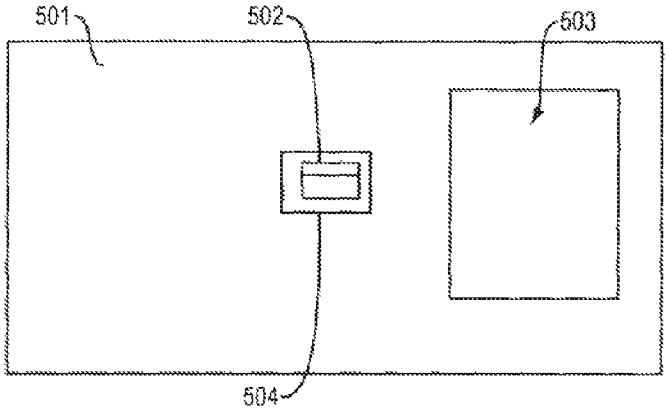
FIG. 5 shows a third example of an arrangement according to the present invention as shown in FIG. 4.

FIG. 5 shows a third example of an arrangement according to the present invention. The drawing is similar to that shown in FIG. 4. Partition wall 501 includes a coupling aperture 503. Capacitive piece 502 is arranged to pass through the partition wall 501 and the partition wall 501 is separated from the capacitive piece 502 by insulation section 504. Although the example of the invention shown in FIG. 5 illustrates a single coupling aperture 503, multiple coupling apertures may be provided in the partition wall 501.

A resonator arrangement according to the present invention does not necessarily have to be rectangular as is shown in the examples, but the resonator arrangement may be, for example cylindrical or another shape. A resonator in a regular geometric shape allows for ease of the calculation of properties and evaluation as wed as ease of industrial manufacturing.

Figure 6:
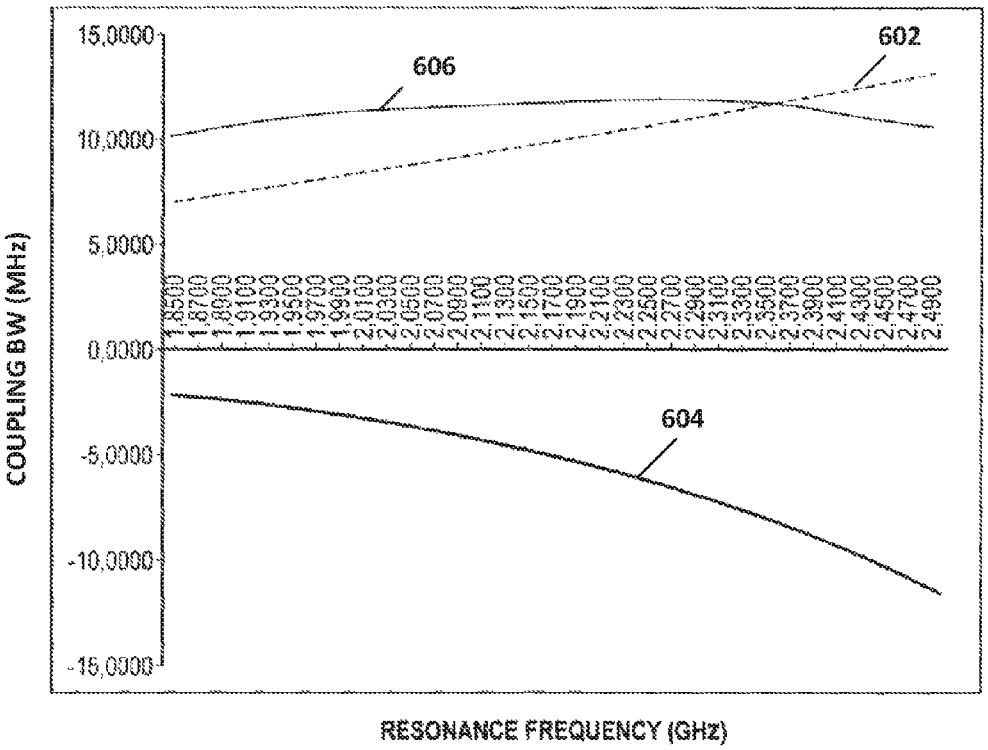
FIG. 6 is a graph of resonance frequency in GHz versus coupling band width (BW) in MHz that shows an example of the arrangement according to the present invention showing the dependence of the coupling band width on the resonance frequency, and on the inductive and capacitive components.

FIG. 6 is an example of relations between the coupling and the resonance frequency of an example of the device of the present invention in which the resonators are adjustable. The x-axis depicts resonance frequency in GHz and the Y-axis depicts coupling band width (BW) in MHz. The invention is shown to perform differently to the resonator of FIG. 1. Inductive coupling 602, the capacitive coupling 604 and the overall coupling 606 are represented for the situation in which the unit arrangement is according to the invention. The amount of capacitive coupling is shown as a negative. It should be noted that the overall coupling does not directly represent the inductive and capacitive coupling amount, but illustrates the situation in which the two frequency conversion connection changes compensate each other so that the overall coupling remains substantially constant.

Figure 7:
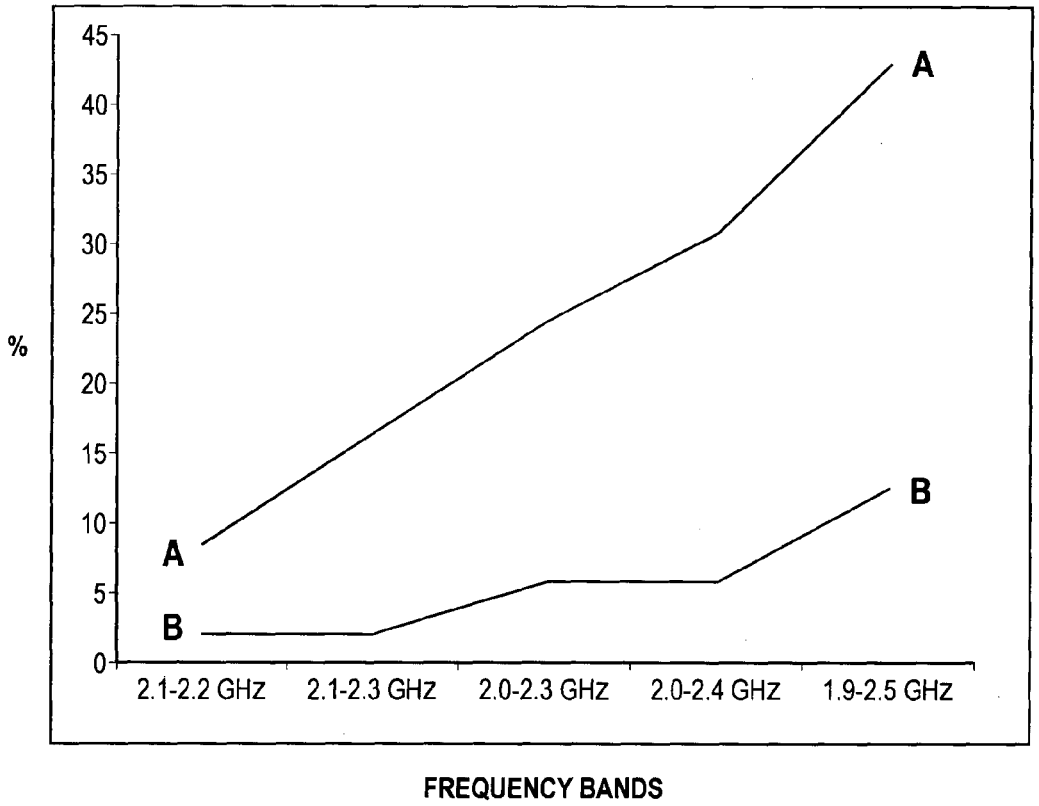
FIG. 7 is a graph of resonance frequency in GHz versus coupling band width in MHz that shows an example of changes in adjusting the coupling resonators in different frequency bands and the arrangement according to the invention versus the traditional method.

FIG. 7 shows by way of example the effects of the example capacitive coupling in different frequency bands in a device of the invention with adjustable resonators. For each frequency band, the resonance frequency of the resonators is changed. Changes in resonant frequency caused by the connection changing are shown in percentages (i.e. %). These changes should be adapted to the curve. In FIG. 7, the curves are shown as curve A and curve B. Curve A illustrates the traditional apparatus. Curve B is obtained by using a device with the arrangement according to the present invention. There are five frequency bands, about 2.1 GHz to about 2.2 GHz, about 2.1 GHz to about 2.3 GHz, about 2.0 GHz to about 2.3 GHz, about 2.0 GHz to about 2.4 GHz and about 1.9 GHz to about 2.5 GHz. The resonant frequency has been changed max to min. Coupling changes are shown in percentages. For example, in the band between about 2.1 to about 2.3 GHz, a change using the traditional apparatus is 15%, whereas the arrangement of the present invention results in a change of only 2%. In the band between about 1.9 GHz to about 2.5 GHz, a change using the traditional device is 43%, but the arrangement according to the present invention produces a change of only 12%.

An arrangement in accordance with the present invention enables the use of adjustable resonators allows for easy adjustment of the device, since the coupling device according to the example is not affected by resonance frequency changes with respect to the changes that occur for existing cavity resonator filters.

Having described the invention in accordance with certain preferred embodiments. The present invention is not limited to the solutions just described, bur the inventive idea can be applied in numerous ways within the limits of die appended claims.

What is claimed is:

1. An adjustable cavity resonator having a bottom, walls and a lid forming a transmission path inner conductor casing, the casing being divided into a plurality of adjustable resonator cavities, a pair of successive adjustable resonator cavities of the plurality of adjustable resonator cavities being separated by an intermediate conductive wall, the pair of successive adjustable resonator cavities including respective inner conductors, which are in electrical connection with the inner conductor casing and having a coupling aperture in the conductive intermediate wall which separates the pair of adjustable resonator cavities, the coupling aperture providing a coarse coupling between the pair of successive adjustable resonator cavities, the coupling aperture being arranged to inductively couple the pair of successive adjustable resonator cavities, characterized in that the coarse coupling has at least one capacitive part, arranged to form a capacitive coupling between the pair of successive adjustable resonator cavities, wherein the capacitive part has a first end extending into a first one of the pair of successive adjustable resonator cavities and a second end extending into a second one of the pair of successive adjustable resonator cavities, wherein the first and second ends of the capacitive part are formed of a conductive material and are galvanically isolated from the intermediate conductive wall, wherein the capacitive part is dimensioned such that as the successive pair of adjustable resonator cavities are tuned, changes in coupling band width caused by the capacitive part tend to cancel changes in the coupling band width caused by the coupling aperture.

2. The adjustable cavity resonator according to claim 1, wherein the capacitive part is characterised in that the capacitive part is an elongated plate-like piece.

3. The adjustable cavity resonator according to claim 1, wherein the first and second ends of the capacitive part are shaped to enhance coupling.

4. The adjustable cavity resonator according to claim 3, wherein the first and second ends of the capacitive part have respective surface areas that are greater than the cross-sectional area of a remainder of the capacitive part.

5. The adjustable cavity resonator according to claim 1 wherein the coupling aperture and the capacitive part are arranged to provide a change in bandwidth of 12 percent when the adjustable cavity resonators are tuned over a range between 1.9 GHz and 2.5 GHz.

6. The adjustable cavity resonator according to claim 1, wherein a magnitude of the change in coupling band width due to the capacitive part is less than an absolute value of the change in coupling band width due to the coupling aperture.

7. The adjustable cavity resonator according to claim 6, wherein the absolute value of the change in coupling band width due to the capacitive part is between 40%-60% of the change in coupling band width due to the inductive coupling of the coupling aperture.

8. The adjustable cavity resonator according to claim 1, wherein the coupling aperture and the capacitive part are arranged in the intermediate conductive wall separating the pair of successive adjustable resonator cavities.

9. The adjustable cavity resonator according to claim 1, wherein the capacitive part is fixed in position with respect to the intermediate conductive wall.

10. The adjustable cavity resonator according to claim 1 wherein the coupling aperture and the capacitive part are arranged to provide a change in bandwidth of 2 percent when the adjustable cavity resonators are tuned over a range between 2.1-GHz and 2.3 GHz.

* * * * *